US005465854A

United States Patent [19]

Sturm et al.

[11] Patent Number: 5,465,854

[45] Date of Patent: Nov. 14, 1995

[54] TELESCOPING TUBE ASSEMBLY

[75] Inventors: Albert J. Sturm, Stillwater; Thomas E. Marrinan, Minneapolis, both of Minn.

[73] Assignee: Par Systems, Inc., Shoreview, Minn.

[21] Appl. No.: 426,634

[22] Filed: Apr. 21, 1995

Related U.S. Application Data

[63] Continuation of Ser. No. 100,911, Jul. 30, 1993, abandoned.

[51] Int. Cl.[6] ..... B66C 17/06

[52] U.S. Cl. ..... 212/319; 212/333; 212/350

[58] Field of Search ..... 212/267, 268, 212/269, 350, 319, 230, 264, 333, 334, 335, 213; 52/732.1

[56] References Cited

U.S. PATENT DOCUMENTS

| | | | |
|---|---|---|---|
| 3,214,033 | 10/1965 | Nillson | 212/55 |
| 3,247,978 | 4/1966 | Neumeier | 214/1 |
| 3,481,490 | 12/1969 | Eiler | 212/55 |
| 3,708,937 | 1/1973 | Sterner | 52/118 |
| 3,736,710 | 6/1973 | Sterner | 52/115 |
| 3,837,502 | 9/1974 | Hornagold | 212/269 |
| 3,840,128 | 10/1974 | Swoboda, Jr. et al. | 214/1 |
| 3,985,234 | 10/1976 | Jouffray | 212/144 |
| 4,004,695 | 1/1977 | Hockensmith et al. | 212/144 |
| 4,016,688 | 4/1977 | Tiffin et al. | 52/118 |
| 4,171,597 | 10/1979 | Lester et al. | 52/118 |
| 4,327,533 | 5/1982 | Sterner | 52/115 |
| 4,459,786 | 7/1984 | Pitman et al. | 52/732.1 |
| 4,534,006 | 8/1985 | Minucciani et al. | 364/513 |
| 4,547,119 | 10/1985 | Chance et al. | 414/735 |
| 4,782,713 | 11/1988 | Torii et al. | 74/89.15 |
| 5,314,083 | 5/1994 | Wiggershaus et al. | 212/269 |

FOREIGN PATENT DOCUMENTS

| | | | |
|---|---|---|---|
| 2307756 | 11/1976 | France . | |
| 2642059 | 7/1990 | France | 212/213 |
| 1025659 | 6/1983 | U.S.S.R. . | |
| 970441 | 9/1964 | United Kingdom . | |
| 2128957 | 5/1984 | United Kingdom . | |

*Primary Examiner*—Michael S. Huppert
*Assistant Examiner*—Thomas J. Brahan
*Attorney, Agent, or Firm*—Westman, Champlin & Kelly

[57] ABSTRACT

An extensible and retractable telescoping tube positions test devices that inspect large stationary objects. The tube has three dimensional adjustment capabilities and is vertically suspended from a frame. The tube sections are independently supported with each section comprising U-shaped housing secured to a thicker support plate. Guide mechanisms preferably mounted only to the thicker plates guide each tube section parallel to a reference axis with improved accuracy so that the position of the remote end of the telescoping tube is precisely known.

23 Claims, 5 Drawing Sheets

TELESCOPING TUBE ASSEMBLY

This invention was made with Government support under Contract No. NA58-37800 awarded by NASA. The Government has certain rights to this invention. This is a continuation of application Ser. No. 08/100,911, filed Jul. 30, 1993,

BACKGROUND OF THE INVENTION

This invention relates to telescoping tubes, and more particularly to longitudinally extensible and retractable telescoping tubes which extend and retract in a vertical direction for inspection testing of large stationary objects.

Various telescoping crane booms have been developed in the past and have been known in the art for some time. An example of an extensible crane boom is shown in U.S. Pat. No. 3,481,490 issued to Eiler which teaches a telescopic crane jib which is formed by welding two folded metal sheets together. The Eiler patent teaches the use of metal of different sheet thicknesses wherein the bottom section is thicker because it is subjected to heavy compressive loads versus the top sheet which is thinner and under tension loads. Eiler further teaches the use of rollers or thrust elements in between each of the telescopic sections. A similar telescoping tubular boom patent is U.S. Pat. No. 4,004,695 issued to Hockensmith et al. which teaches a tubular boom with a thicker, flat bottom plate and a thinner channel having the free edges of its walls welded to the bottom plate at the lateral edges of the bottom plate. Hockensmith also teaches the placement of wear pads for supporting an outer boom section about the periphery of each prior section to provide substantially columnar support for the walls of the outer section while reducing bottom plate bending forces.

As one can see, these telescoping crane booms involve lifting substantial weights or loads which cause very large bending moments on the crane boom. These crane boom bending moments and forces are offset typically by increasing the boom rigidity and strength through increasing the width of each boom section. This increase in width adds excessive weight in an attempt to combat the moment created about its base. Thus, various alternatives, such as thicker flat bottom plates and thinner surrounding channels have been used in attempts to lighten the weight while increasing the strength.

Vertically telescoping devices, which are similar in appearance to the crane booms involve considerably different design considerations. Instead of being concerned about compressive loads on a lower section versus tension loads on a top section as well as the bending moment about its base as in the crane booms, vertically telescoping tubes, operating generally in the same direction as gravity, are more concerned about accurate movement, higher rigidity, higher dampening, low-cost construction, and linear load capability.

The art area of vertically telescoping tubes or extensible/retractable members typically involves inventions more concerned with accuracy, reliability and control, in contrast to crane booms, which are more concerned with the distance a load can be supported and how large of a load can be supported safely by the boom. British Patent No. 970,441 discloses a power manipulator which vertically positions itself by extending a column assembly comprising a number of telescoping sections adapted to rest one within another. This patent further teaches that control of position is important thus the vertical movement should be as smooth as possible. The British patent discloses a column comprising an assembly of three telescopic tubes which rest one within another and are stowed within a carriage. Three pairs of rollers are carried on the inner surface of a cylindrical shroud at the base of the carriage and these three pairs of rollers cooperate with three equally spaced vertical guides on the outermost tube. The middle and inner tube are similarly guided.

It is desirable to improve vertically telescoping tubes such that a higher accuracy, higher rigidity, higher dampening and low-cost construction exist. Such an improvement is needed so that when testing devices are attached to the end of the vertically telescoping tube, extreme accuracy will result when retracting or extending the vertically telescoping tube such that the tube is always properly positioned thereby allowing a proper recording of its position to be made with the corresponding structural integrity measurements. It is important that the vertically telescoping tube be capable of being used in high precision applications where high repeatability, quick settling times, and no loss of motion are of paramount importance.

SUMMARY OF THE INVENTION

The invention relates to vertically extensible telescoping tubes. The telescoping tube is suspended from a frame and extends and retracts in a vertically manner so that a test device can be properly positioned to inspect large stationary objects for structural integrity. The vertically telescoping tube is horizontally movable about the frame for the purpose of properly positioning the test device in reference to the large stationary object and for moving the test device about the outer perimeter of the larger stationary object during testing.

The vertically extensible telescoping tube assembly has a frame supporting an elevated mounting platform off of which the vertically telescoping tube operates. The telescoping tube extends vertically from the mounting platform along a reference axis perpendicular to the mounting platform. The telescoping extensible tubes consists of a fixed longitudinal tube section attached to the mounting platform where a second longitudinal section telescopes relative to the fixed longitudinal tube section. Each longitudinal tube section is a rigid support plate with a U-shaped housing having two spaced apart longitudinal edges which attach to the rigid ,support plate.

Between each longitudinal section are bearings or wheels which allow for the telescopic movement. The bearings or wheels are positioned to make contact only with the rigid support plates for purposes of guiding the longitudinal tubes. By making contact only with the rigid support plates and not about the perimeter of each tube as is done commonly in the art of vertical tubes, bulging of the U-shaped housings, which contributes to deflection of each tube section, is eliminated. Preferably, the contacting portions of the bearings or wheels are positioned proximate each other and if possible overlap so that substantially all of the forces are transferred through the rigid support plates of the moveable tube sections to the rigid support plate of the fixed housing.

In the preferred embodiment, the vertically extensible telescoping tube includes five sections of equivalent length but of decreasing width and depth such that each succeeding section may retract and nest in the preceding section. In this embodiment, the telescoping action is produced by rotation of four drum systems of effective differing diameter, wherein each drum has a drive cable wrap therearound with each drive cable being attached to a different longitudinal section. These drive cables and varying diameter drums resulting in retraction and extension of the telescoping sections such that equivalent exposed portions always exist.

Also in the preferred embodiment, a flexible conduit is connected at one end to a conduit housing mounted on the outside of the fixed longitudinal tube section and at the other end of the conduit to one of the telescoping longitudinal sections at least once removed from the fixed longitudinal section such that the flexible conduit forms at least one loop that extends and retracts with the telescoping tube. This flexible conduit protects wires, cables or the like from binding up the telescoping system or being kinked or severed.

DETAILED DESCRIPTION OF THE PREFERRED EMBODIMENTS

Figure 1:
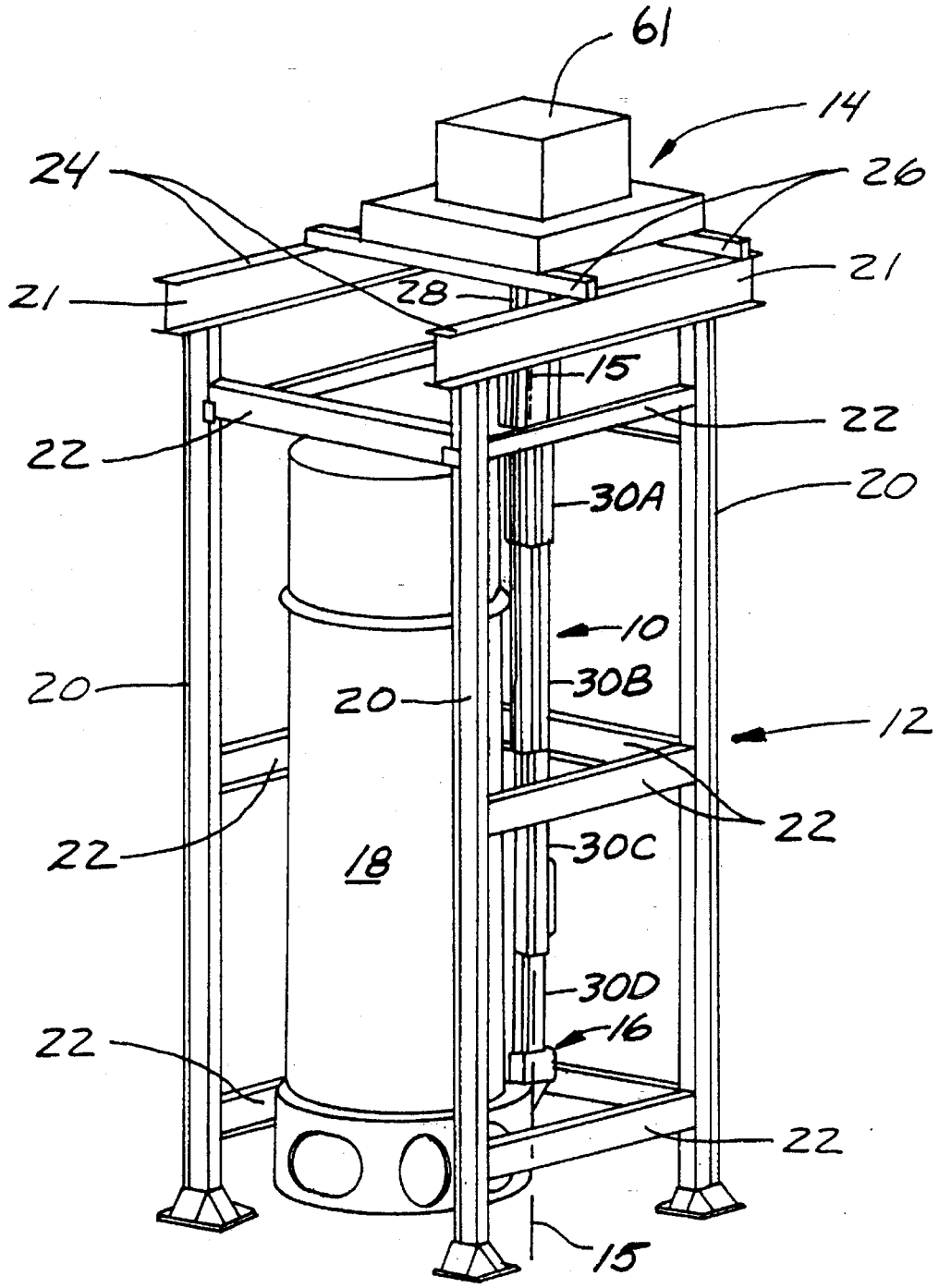
FIG. 1 is a perspective view of a telescoping tube of the present invention mounted to an elevated frame.

Illustrated generally in FIG. 1 at 10 is a longitudinally extensible and retractable telescoping tube of the present invention. The telescoping tube 10 is attached to a frame 12 on an elevated mounting platform 14. The telescoping tube 10 extends and retracts in a longitudinally vertical direction from the mounting platform 14 along a reference axis 15 allowing a test device 16 mounted on a remote end thereof to inspect a large stationary object such as a tank 18. The construction of the telescoping tube 10, described in detail below, provides a compact rigid structure so that high accuracy is maintained with respect to the reference axis 15. Therefore, the precise location of the test device 16 can be determined easily.

In more detail, the frame 12 is a shell-like structure with four support legs 20 and various cross-supports 22. At the top of the frame 12, mounted on upper cross supports 21, are two perpendicular sets of parallel slide tracks referred to as first horizontal slide tracks 24 and second horizontal slide tracks 26. The two sets of horizontal slide tracks 24 and 26 allow horizontal movement of the mounting platform 14 in a plane perpendicular to the reference axis 15. The first horizontal slide tracks 24 fixedly attach to the cross support 21 guide the second set of horizontal slide tracks 26 in movement along the cross supports 21 using a conventional drive mechanism, not shown. The mounting platform 14 is movable upon the second horizontal slide tracks. Movement of the platform 14 in this plane positions the telescoping tube 10 and accompanying reference axis 15 about the large stationary object 18. When combined with telescoping movement of the tube 10 along the reference axis 15 complete inspection of its outside surface is possible.

Figure 2:
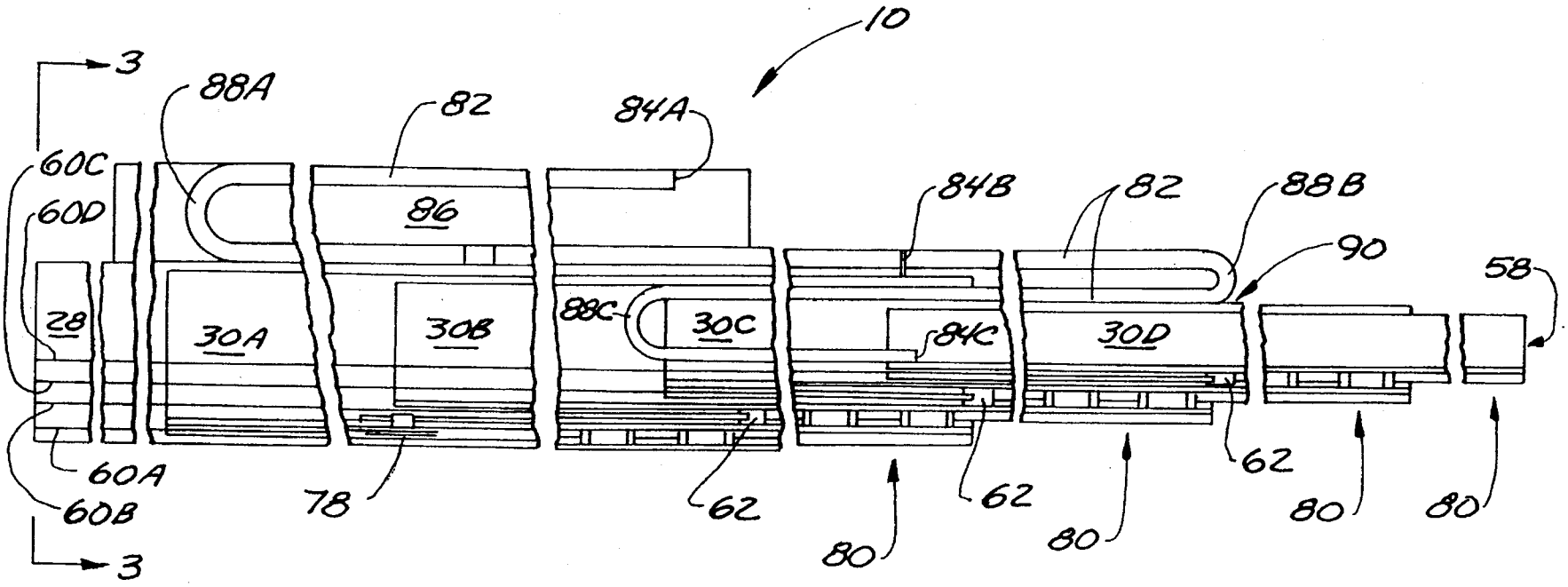
FIG. 2 is a schematic view of the interior of the telescoping tube.

In the preferred embodiment, the telescoping tube 10 is made up of five longitudinal tube sections 28, 30A, 30B, 30C and 30D illustrated schematically in more detail in FIG. 2. It is to be understood that the number of sections may be increased or decreased without altering the objective or performance of the invention. The uppermost longitudinal tube section 28 is fixed to the mounting platform 14. Each of the four succeeding tube 30A–30D sections is vertically movable such that each extends and retracts from within the preceding larger section in a telescoping manner. Specifically, the first telescoping tube section 30A extends and retracts from within the fixed longitudinal section 28; the second telescoping longitudinal tube section 30B extends and retracts from within the first longitudinal tube section 30A; the third telescoping longitudinal tube section 30C extends and retracts from within the second longitudinal tube section 30B; and the fourth telescoping longitudinal tube section 30D extends and retracts from within the third longitudinal tube section 30C.

In the embodiment illustrated, the four telescoping sections 30A–30D are fully retracted wherein the four telescoping sections 30A–30D nest within the fixed section 28. When the four telescoping sections are fully extended, each telescoping section is overlapped by the section preceding it thereby allowing transfer of the forces through the support plates.

Figure 3:
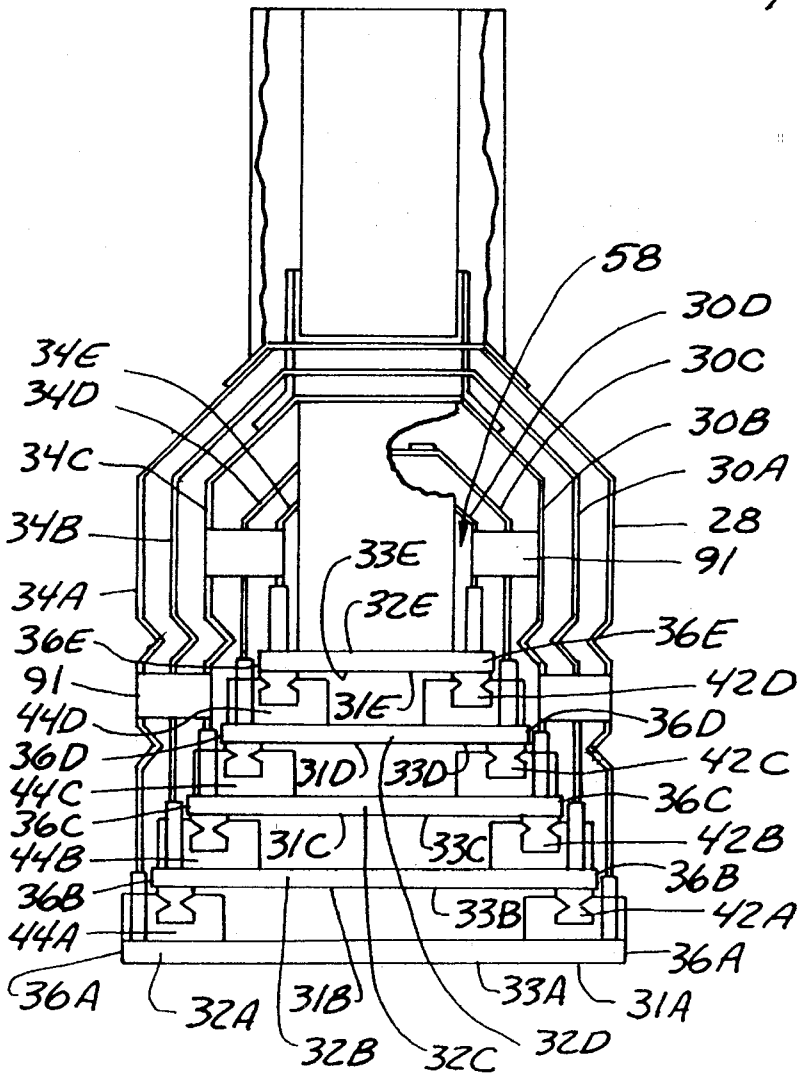
FIG. 3 is an end view of the telescoping tube taken along line 3—3 in FIG. 2 with parts broken away.

Structural rigidity of the telescoping tube 10, in order to maintain its position on the reference axis 15, is provided by the construction of each tube section. FIG. 3 illustrates that each of the sections 28 and 30A–30D include a relatively thin U or similar shaped housing 34A, 34B, 34C, 34D and 34E joined to a thicker support plate 32A, 32B, 32C, 32D and 32E along a pair of longitudinal edges 36A, 36B, 36C, 36D and 36E, respectively. The thicker support plates 32A–32E, although sufficiently rigid for compressive loading, are inherently weak to torsion bending.

The attachment of the thin housings 34A–34E to each respective thick support plate 32A–32E produces a higher rigidity structure by providing a load path for shear loads. Preferably, the housings 34A–34E are bolted to each respective thicker support plate 32A–32E as desired. For instance, the replaceable construction allows the user, if he chooses, to construct the thin housing 34A–34E from, for example, a lighter material such as aluminum or a composite material to suit various applications. This concept of the thin housing 34 being made of a different material results in improved strength to weight ratios which results in improved natural frequency and thus increased damping. Replacability of the housings 34A–34E also aids in repair in the event one of the tube sections were to be damaged. In this manner only the damaged part need be replaced rather than the whole tube section.

In the preferred embodiment, a layer of ISD-110 damping material 31A, 31B, 31C, 31D and 31E, such as Polymer Constraining Layered Damping Material, manufactured by 3M Company, St. Paul, Minn., is applied to an inside surface 33A, 33B, 33C, 33D and 33E of each support plate 32A–32E. Location of the damping material on the inside surfaces 33A–33E is preferred since the neutral axis of each tube section is proximate on this surface due to greater mass of the support plates 32A–32E relative to the housings 34A–34E.

As illustrated in FIG. 3, two parallel linear bearing tracks 42A, 42B, 42C and 42D are connected to the thick support plates 32B–32E on each of the sections. The sets of linear bearing tracks 42A–42D are attached to the opposite side of the thick support plate 32A–32D as the thin housing 34A–34E, while sets of linear bearings 44A, 44B, 44C and 44D engage the tracks 42A–42D in a conventional manner to maintain the position of each support plate 32A–32E, and the tube sections 28 and 30A–30D relative to each other and parallel to the reference axis 15.

Each telescoping section 30A–30D has one set of four linear roller 10 bearings, where a sequential-pair of linear roller bearings engages each of the two parallel bearing tracks 42A–42D. As illustrated in FIG. 3, the sets of bearings 44A-44D are mounted to the rigid support plates 32A–32E in overlapping placement so that force loads can be transferred directly through the support plates 32A–32D to the fixed tube section 28. The linear bearings thus concentrate the aligning forces between the support plates 32A–32E to a common selected portion of each plate that being proximate the longitudinal edges of the support plates 32A–32E.

Figure 5:
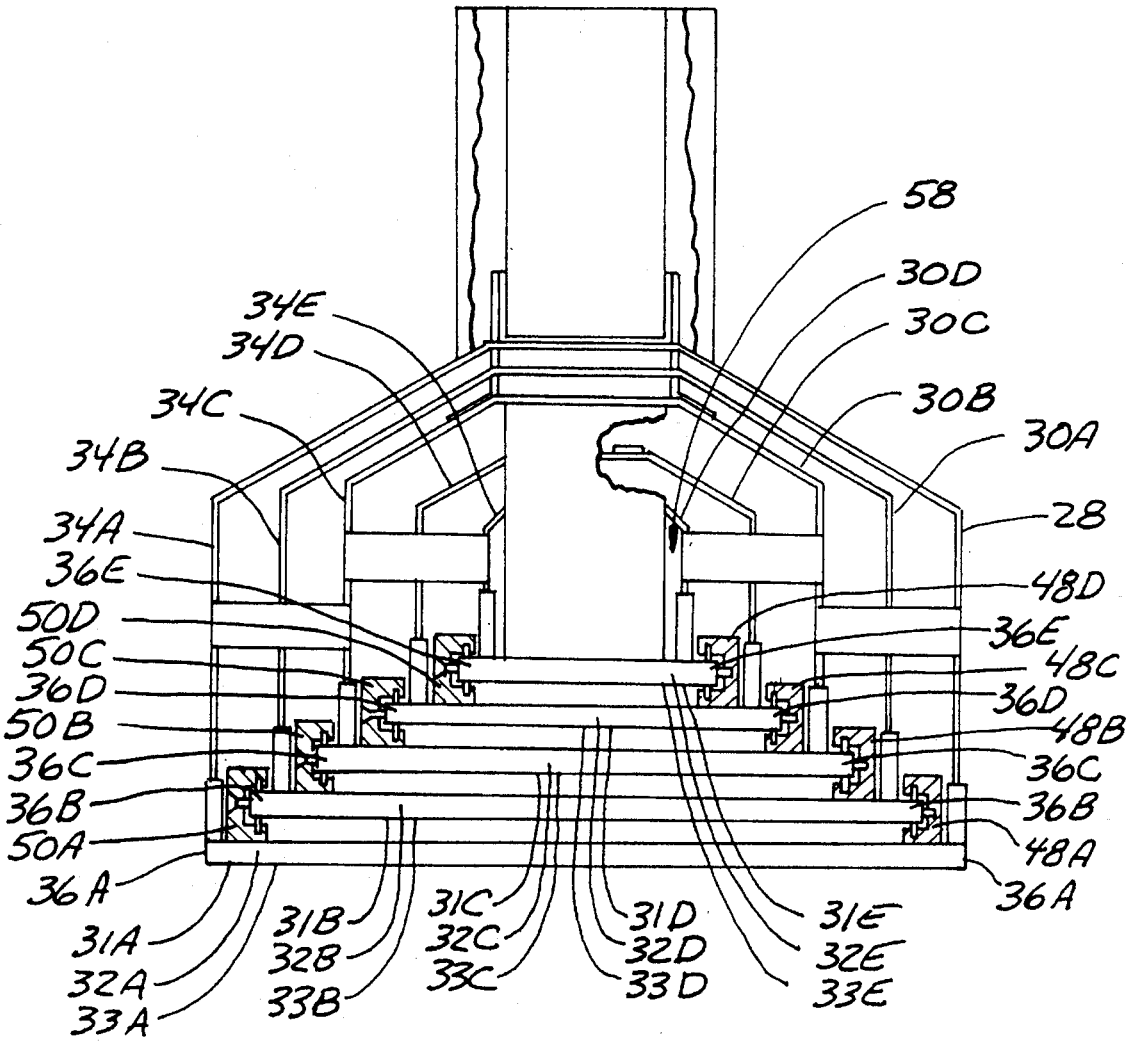
FIG. 5 is an end view of a second embodiment of the telescoping tube of the present invention with parts broken away.

FIG. 5 illustrates a second embodiment wherein linear bearings 44 and bearing tracks 42 have been replaced by C-brackets 48A, 48B, 48C and 48D each C-bracket having a set of three wheels 50A, 50B, 50C and 50D or multi-directional bearings situated therein. The thick support plates 32A–32E are guided relative to each other on the lateral edges 36A–36E of each of the thick support plates 32A–32E. The thin housing 34A–34E is bolted about its edges to the thick support plate 32A–32E at a position in from the lateral edges 36A–36E of the thick support plate 32A–32E so the C-brackets 48A–48D can be positioned about these lateral edges 36A–36E to allow the succeeding longitudinal section to extend and retract. Preferably, four C-brackets 48A–48D, (similar to the linear bearings 44A–44D) with two about each lateral edge 36A–36D of each of the thick support plates 32B–32E allow retraction and extension of the succeeding longitudinal section. Like the embodiment of FIG. 3, forces are transferred only through the support plates. In the embodiment, the C-brackets are positioned about the longitudinal sides of the support plates to concentrate transfer of forces along the edges.

In both the parallel linear bearing tracks 42A–42D with linear bearings 44A–44D embodiment, and the C-brackets 48A–48D with wheels 50A–50D embodiment, the tracks 42A–42D and bearings 44A–44D, and the C-brackets 48A–48D and wheels 50A–50D are attached only to the thick and rigid support plates 32A–32E. This results in the forces being displaced between the sections 28 and 30A–30D only through the rigid support plates 32A–32E, where each rigid support plate 32A–32E is strengthened by a U-shaped housing 34A–34E. By making contact only with the rigid support plates and not about the perimeter of each tube as is done commonly in the art of vertical tubes, bulging of the U-shaped housings, which would contribute to deflection of each tube section, is eliminated.

A central aperture 58 is formed by the five hollow longitudinal apertures 38 being aligned. The longitudinal tube sections 28 and 30A–30D, which are held together by the interaction between the linear bearings 44A–44D and the bearing tracks 42A–42D, or in the alternative the C-brackets 48A–48D and the wheels 50A–50D, have drive cables 60A, 60B, 60C and 60D attached thereto and running through the central aperture 58. The drive cables 60A–60D connect to a drive mechanism 61 (FIG. 1 ) located on the mounting platform 14, which controls the amount of extension and retraction of that corresponding tube section. The drive cables 60B–60D are connected to the thick support plates 32B–32D with fasteners 62 attached to an end of each of the drive cables. Each of the fasteners 62 is bolted to the corresponding support plate 32B–32D. The drive cable 60A is connected to the thick support plate 32A with a pulley 78, which will be discussed later.

Figure 6:
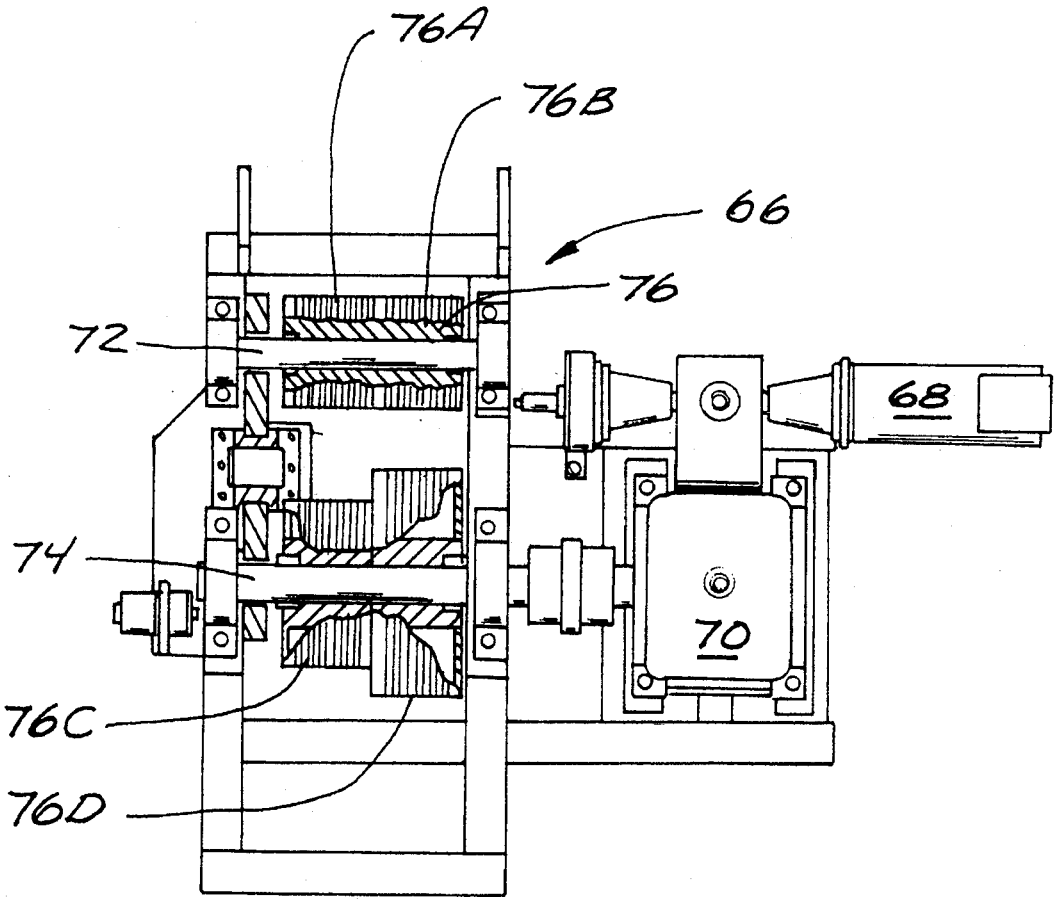
FIG. 6 is a plan view of a drive mechanism for the telescoping tube.

Referring to FIG. 6, a controller, not shown, signals to a drum reel system 66 to take in or release out the drive cables 60A–60D thereby controlling the extension and retraction of the telescoping tube 10 as a whole. The reel system 66, which is attached to the mounting plate 14, is comprised of spools or drums 76A, 76B, 76C and 76D which are rotated to take in or let out the drive cables 60A–60D as desired through instructions from the controller 64. Preferably, the telescoping sections 30A–30D are extended and retracted for positioning inspection test devices 16. Each of the four telescoping sections extends in equal increments thereby exposing the same length of section as is exposed by the other three telescoping sections.

The reel system 66 in more detail includes a motor 68 which drives a gear box 70. Inside this gear box 70 is a driving mechanism causing the motor 68 to drive two axles 72 and 74 at the same rotational speed. Two spools or drums are attached to each of the two axles such that four total drums exist. On the first axle 72 is the first drum 76A and the second drum 76B, while on the second axle 74 is the third drum 76C and the fourth drum 76D.

The first drive cable 60A wraps about the first drum 76A and is connected at its other end to the first telescoping tube section 30A which is the section nearest the fixed tube section 28. The second drive cable 60B wraps about the second drum 76B and is connected at its other end to the second telescoping tube section 30B. Both the first drum 76A and the second drum 76B have the same diameter. However, as stated above, it is preferred that all of the tube sections move equal distances during movement of the telescoping tube 10. Therefore, the second telescoping tube section 30B must move at twice the speed as the first telescoping tube section 30A. A pulley 78 is used to accomplish this desired result. The first drive cable 60A operates about the pulley 78 and continues such that it re-connects to the mounting platform 14 instead of directly to the first telescoping section 30A. The pulley 78 is attached to this first telescoping tube section 30A and therefor the first telescoping tube section 30A moves at half the speed as the second telescoping tube section 30B when the same amount of cable is released from the same size drum attached to the same axle 72.

It is to be understood that the second drum 76B could be designed to be twice the diameter of the first drum 76A thereby allowing twice as much length of the second drive cable 60B to extend or retract as the first drive cable 60A when the first axle 72 is rotated. This would result in elimination of the need for the pulley 78.

On the second axle 74 is the third drum 76C and the fourth drum 76D. The third drive cable 60C wraps about the third drum 76C and is connected at its other end to the third telescoping section 30C. The fourth drive cable 60D wraps about the fourth drum 76D and is connected at its other end to the fourth telescoping section 30D. The third drum 76C is of smaller diameter than the fourth drum 76D such that the fourth telescoping section 30D telescopes at a faster rate than the preceding sections such that the exposed portion 80 of each of the telescoping sections 30 remains of equal length during extension and retraction of the telescoping tube 10.

The ratios of the differences in diameter of each of the drums 76A–76D so that each telescoping section 30 will extend and retract in equal increments is as follows. The second telescoping section 30B must move twice the distance in comparison to the first telescoping section 30A so that the second drum 76B should be twice as large as the first drum 76A; however, the first and second drums 76A and 76B are of the same diameter because of use of the pulley 78 thereby causing the first telescoping section 30A to move at half the rate of the second telescoping section 30B. The third telescoping section 30C must move one and a half times faster than the second telescoping section 30B so that the third drum 76C is one and a half times larger than the second drum 76B. Finally, the fourth telescoping section 30D must move one and one third times faster than the third telescoping section 30C so that the fourth drum 76D is one and one-third times larger than the third drum 76C. These various drum sizes allow the telescoping tube 10 to telescope each telescoping section 30 in a manner such that each is equally extended and retracted in the telescoping process.

In an alternative embodiment not shown, the drum reel system includes a motor which drives a gear box where inside this gear box are differential gearing means such that the motor drives the two axles through the gear box at different speeds. This allows the size ratio of the first and second drums versus the third and fourth drums to be correspondingly altered based upon the change in axle speed.

Also running through a portion of the central aperture 58 is a flexible conduit 82. Running through the flexible conduit 82 are wires (not shown) for measurement, control and the like, where the wires can be electric wires, fiber optic cables, pneumatic tubes, and the like. The measurement and control wires are connected to data receiving devices (not shown) on the mounting platform 14 and frame 12. The flexible conduit 82 is mounted to the telescoping tube 10 at a first attachment point 84A in a conduit housing 86 attached to the outside of the fixed section 28. The flexible conduit 82 is fastened to the housing 86 so that when the telescoping sections 30 are extended and retracted the measurement and control wires do not tangle but instead they curl upward and downward within the flexible conduit 82 at a first curve 88A as required by the telescoping action. The first curve 88A moves within the housing 86 since the flexible conduit 82 is not attached to the fixed section 28 or the first telescoping section 30A except for at the first attachment point 84A. The flexible conduit 82 curls at a second curve 88B and extends through a passage 90 into the hollow longitudinal aperture 38 between the second 30B and third 30C telescoping tube sections where it is fastened at a second attachment point 84B which is on the third telescoping tube section 30C. In the hollow longitudinal aperture the flexible conduit 82 faces an upward direction so that when the telescoping sections 30 are extended and retracted the measurement and control wires do not tangle but instead move upward or downward based upon the movement of a third curve 88C of the flexible conduit 82. The third curve 88C moves since the flexible conduit 82 is not attached to any of the longitudinal sections 30A–30C about the central apertures 58 except to the fourth telescoping tube section 30D. The flexible conduit 82 is fastened in a downward direction on the fourth telescoping section 30D at a third attachment point 84C whereat signal leads or the like connects in a conventional manner to the inspection test device 16.

Figure 4:
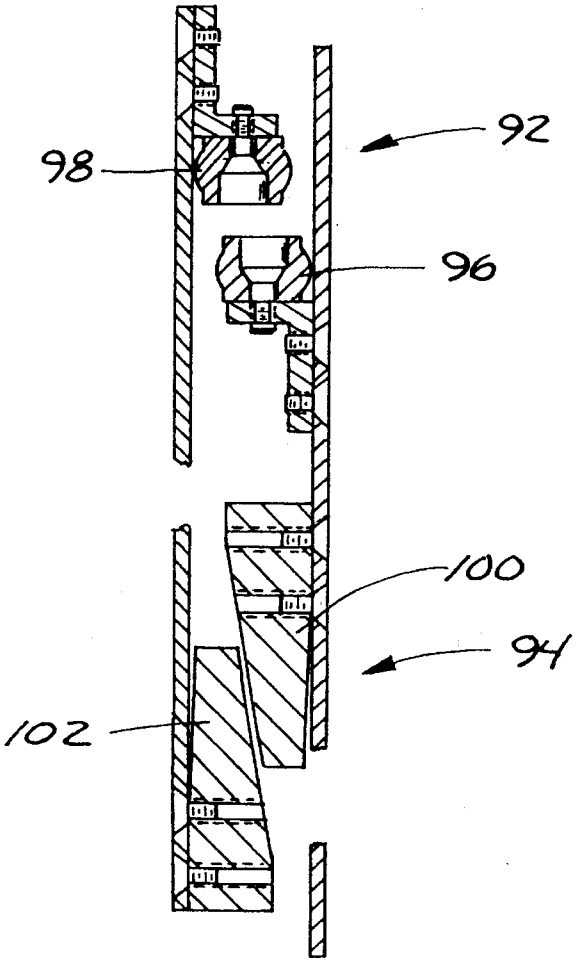
FIG. 4 is a sectional view of one set of stops.

Referring to FIG. 4, stops generally shown at 91 limit telescoping movement of the tube sections relative to each other. Each telescoping section 30A–30D contains an upper stop 92 and a lower stop 94. The upper stop 92 functions perpendicular to the motion of the longitudinal section such that the tube section is blocked from further upward motion. Each upper stop 92 includes an outwardly extending block 96 on each of the telescoping sections 30 which comes into contact with an inwardly extending block 98 on the section that precedes the one with the outwardly extending block 96. The lower stop 94 increasingly absorbs energy under increased friction until further motion is restrained when an outwardly extending brake or wedge 100 on a telescoping section comes into contact with an inwardly extending brake or wedge 102. The outwardly extending wedge 100 is of decreasing dimension from top to bottom while the inwardly extending wedge 102 is of increasing dimension from top to bottom such that when in contact they will interact to cease relative motion between the corresponding reactions.

In summary, an extensible and retractable telescoping tube positions test devices that inspect large stationary objects. The tube has three dimensional adjustment capabilities and is vertically suspended from a frame. Each tube sections comprises a U-shaped housing secured to a thicker support plate. Drive cables attached at one end to a tube section and at the other end to a drive mechanism cause the telescoping movement. Guide mechanisms, such as linear bearings and corresponding tracks, or a C-bracket and wheel combination, mounted to each of the thicker support plates guide the plates parallel to a reference axis with improved accuracy and with structural rigidity so that the positions of the remote end of the telescoping tube is precisely known, thereby improving the testing results of the test device attached to the end of the extensible and retractable telescoping tube.

Although the present invention has been described with reference to preferred embodiments, workers skilled in the art will recognize that changes may be made in form and detail without departing from the spirit and scope of the invention.

What is claimed is:

1. A vertically extensible telescoping tube assembly comprising:

a frame supporting an elevated mounting platform;

telescoping tube means supported from the mounting platform to extend vertically therefrom along a reference axis perpendicular to the mounting platform, the telescoping tube means comprises:

a fixed longitudinal tube section adapted for vertical support from the mounting platform;

a second longitudinal tube section telescoping relative to the fixed longitudinal tube section;

wherein each longitudinal tube section includes a U-shaped housing having two spaced apart longitudinal edges and a rigid support plate of thickness greater than the U-shaped housing joined to the spaced apart longitudinal edges to form a tube, the rigid support plate being parallel to the reference axis; and guide means joining each of the support plates for facilitating telescopic movement of the second longitudinal tube section parallel to the fixed longitudinal tube section, the guide means consisting of a guide mechanism that makes contact with and guides only the rigid support plate of the second longitudinal tube section relative to the rigid support plate of the fixed longitudinal tube section, whereby the guide means contacting the rigid support plates is the sole guide for the telescoping tube means.

2. The vertically extensible telescoping tube assembly of claim 1 wherein the telescoping means further comprises a third longitudinal tube section telescoping relative to the second longitudinal tube section, the third longitudinal tube section also comprising a U-shaped housing having spaced apart longitudinal edges and rigid support plate of thickness greater than the corresponding U-shaped housing; and second guide means joining the rigid support plate of the second longitudinal section with the rigid support plate of the third longitudinal section for facilitating telescopic movement of the third longitudinal tube section parallel to the second longitudinal tube section, the second guide means consisting of a second guide mechanism that makes contact with and guides only the rigid support plate of the third longitudinal tube section relative to the rigid support plate of the second longitudinal tube section.

3. The vertically extensible telescoping tube assembly of claim 2 and further comprising drive means for telescopically moving the second longitudinal tube section relative to the fixed longitudinal section and the third longitudinal tube section relative to the second longitudinal tube section, and wherein the drive means further simultaneously moves the third longitudinal tube section telescopically relative to second longitudinal a distance equal to displacement between the second longitudinal section and the fixed longitudinal section, whereby the guide means contacting the rigid support plates is the sole guide for the telescoping tube means.

4. The vertically extensible telescoping tube assembly of claim 3 wherein drive means includes drum means mounted to the platform, the drum means including a first drive cable connected to the second longitudinal tube section and a second drive cable connected to the third longitudinal tube section, the drum means winding and unwinding the first and second drive cables to telescopically move the telescoping means.

5. The vertically extensible telescoping tube assembly of claim 2 wherein each guide means further concentrates aligning forces to common selected areas of each rigid support plate.

6. The vertically extensible telescoping tube assembly of claim 5 wherein each of the guide mechanisms includes wheels for contacting surfaces of one of the rigid support plates.

7. The vertically extensible telescoping tube assembly of claim 5 wherein each of the guide mechanisms includes a linear bearing positioned between the rigid support plates of the fixed and the second longitudinal tube sections.

8. The vertically extensible telescoping tube assembly of claim 5 wherein each longitudinal tube section comprises means for replaceably attaching the U-shaped housing to the corresponding rigid support plate.

9. The vertically extensible telescoping tube assembly of claim 8 wherein the means for replaceably attaching comprises a plurality of bolts spaced apart along each of the spaced apart longitudinal edges.

10. The vertically extensible telescoping tube assembly of claim 8 wherein the U-shaped housing of each longitudinal tube section is made of material different than its corresponding support plate.

11. The vertically extensible telescoping tube assembly of claim 2 wherein the U-shaped housing of each longitudinal tube section is made of material different than its corresponding support plate.

12. The vertically extensible telescoping tube assembly of claim 2 further comprising flexible conduit means connected at a first end to a conduit housing mounted on the outside of the fixed longitudinal tube section and at a second end to the third longitudinal tube section for protecting wires extending from the fixed longitudinal tube section to the third longitudinal tube section.

13. The vertically extensible telescoping tube assembly of claim 1 and further comprising stop means mounted to each tube section for limiting movement between the second longitudinal tube section and the fixed longitudinal tube section.

14. The vertically extensible telescoping tube assembly of claim 13 wherein the stop means comprises a first stop block mounted to the fixed longitudinal tube section and a second stop block mounted to the second longitudinal tube section, wherein movement of the second longitudinal tube section is stopped upon sufficient contact made between the first and second stop blocks.

15. The vertically extensible telescoping tube assembly of claim 14 wherein the first stop block includes a first inclined contact surface and the second block includes a second inclined contact positioned relative to the first inclined contact surface so that relative displacement between the blocks in opposite directions with contact made between the inclined surfaces provides increasing friction therebetween.

16. The vertically extensible telescoping tube assembly of claim 1 further comprising coating means mounted on a surface of each rigid support plate between the U-shaped housing of each longitudinal section and the rigid support plate, for passive damping.

17. A telescoping tube assembly comprising:

a frame supporting an elevated mounting platform;

telescoping tube means supported from the mounting platform to extend therefrom along a reference axis, the telescoping tube means comprises:

a fixed longitudinal tube section adapted for support from the mounting platform;

a second longitudinal tube section telescoping relative to the fixed longitudinal tube section;

wherein each longitudinal rue section includes a U-shaped housing having two spaced apart longitudinal edges and a rigid support plate of thickness greater than the U-shaped housing joined to the spaced apart longitudinal edges to form a tube, the rigid support plate being parallel to the reference axis; and guide means joining each of the support plates for facilitating telescopic movement of the second longitudinal tube section parallel to the fixed longitudinal tube section, the guide means consisting of a guide mechanism that makes contact with and guides only the rigid support plate of the second longitudinal tube section relative to the rigid support plate of the fixed longitudinal tube section, whereby the guide means contacting the rigid support plates is the sole guide for the telescoping tube means.

18. The telescoping tube assembly of claim 17 wherein the telescoping means further comprises a third longitudinal tube section telescoping relative to the second longitudinal tube section, the third longitudinal tube section also comprising a U-shaped housing having spaced apart longitudinal edges and rigid support plate of thickness greater than the corresponding U-shaped housing; and second guide means joining the rigid support plate of the second longitudinal section with the rigid support plate of the third longitudinal section for facilitating telescopic movement of the third longitudinal tube section parallel to the second longitudinal tube section, the second guide means consisting of a second guide mechanism that makes contact with and guides only the rigid support plate of the third longitudinal tube section relative to the rigid support plate of the second longitudinal tube section.

19. The telescoping tube assembly of claim 18 wherein each longitudinal tube section comprises means for replaceably attaching the U-shaped housing to the corresponding rigid support plate.

20. The telescoping tube assembly of claim 19 wherein the means for replaceably attaching comprises a plurality of bolts spaced apart along each of the spaced apart longitudinal edges.

21. The telescoping tube assembly of claim 18 wherein each guide means further concentrates aligning forces to common selected areas of each rigid support plate.

22. The telescoping tube assembly of claim 21 wherein each of the guide mechanisms includes wheels for contacting surfaces of one of the rigid support plates.

23. The telescoping tube assembly of claim 21 wherein each of the guide mechanisms includes a linear bearing positioned between the rigid support plates of the fixed and the second longitudinal tube sections.

* * * * *